US007168132B2

(12) United States Patent
Dürr et al.

(10) Patent No.: US 7,168,132 B2
(45) Date of Patent: Jan. 30, 2007

(54) PORTABLE HANDHELD WORK APPARATUS HAVING THUMB SUPPORTS

(75) Inventors: Bernhard Dürr, Stuttgart (DE); Michael Tinius, Elchingen (DE); Jörg Schlossarczyk, Winnenden (DE); Günter Wolf, Oppenweiler (DE); Martin Schif, Waiblingen (DE); Werner Geyer, Berglen (DE); Michael März, Waiblingen (DE); Jürgen Häberlein, Murrhardt (DE)

(73) Assignee: Andreas Stihl AG & Co., Waiblingen (DE)

( * ) Notice: Subject to any disclaimer, the term of this patent is extended or adjusted under 35 U.S.C. 154(b) by 461 days.

(21) Appl. No.: 10/097,587

(22) Filed: Mar. 15, 2002

(65) Prior Publication Data

US 2002/0129502 A1 Sep. 19, 2002

(30) Foreign Application Priority Data

Mar. 16, 2001 (DE) ..... 201 04 536 U

(51) Int. Cl.
*A47B 95/02* (2006.01)

(52) U.S. Cl. ..... 16/110.1; 16/421; 123/41.56

(58) Field of Classification Search ..... 16/110.1, 16/421, 430; 30/384, 298.4, 296.1, 381; D8/64; 123/41.56, 41.69, 41.7, 198 E
See application file for complete search history.

(56) References Cited

U.S. PATENT DOCUMENTS 241,498 A * 5/1881 Levalley ..... 56/215
3,019,673 A 2/1962 Sjöstrand et al.
D237,352 S * 10/1975 Shymkus ..... D8/65
4,411,071 A * 10/1983 Takahashi et al. ..... 30/381
D272,310 S * 1/1984 Dynie et al. ..... D8/65
4,932,126 A * 6/1990 Pilatowicz et al. ..... 30/216
5,094,000 A * 3/1992 Becht et al. ..... 30/475
D333,217 S * 2/1993 Gingras ..... D4/135
5,254,117 A * 10/1993 Rigby et al. ..... 606/46
5,272,813 A * 12/1993 Wolf et al. ..... 30/298.4
D350,680 S * 9/1994 Berfield et al. ..... D8/65
5,411,150 A * 5/1995 Sigurdsson ..... 209/235
5,535,484 A * 7/1996 Gibson ..... 16/430
5,570,512 A 11/1996 Höppner
D378,184 S * 2/1997 Naslund et al.
5,638,945 A * 6/1997 Fukinuki et al. ..... 200/43.17
5,778,747 A * 7/1998 Chen ..... 83/471.3
5,829,099 A * 11/1998 Kopelman et al. ..... 16/430
5,870,939 A * 2/1999 Matsubara ..... 83/471.3
5,946,762 A * 9/1999 Dionisio ..... 15/245
D415,899 S * 11/1999 Barton et al. ..... D4/138
6,000,096 A 12/1999 Everts et al.
6,009,600 A * 1/2000 Egeland et al. ..... 16/436

(Continued)

FOREIGN PATENT DOCUMENTS

DE 3540565 A1 * 6/1987

(Continued)

*Primary Examiner*—Brian E. Glessner
*Assistant Examiner*—Mark Williams
(74) *Attorney, Agent, or Firm*—Walter Ottesen

(57) ABSTRACT

The invention relates to a portable handheld work apparatus including a chain saw, a vacuum/blower apparatus or the like. The work apparatus has a handle (2) for carrying and guiding the work apparatus (1). Thumb supports (4, 5) are provided on both sides with respect to the longitudinal axis (3) of the handle (2).

10 Claims, 3 Drawing Sheets

U.S. PATENT DOCUMENTS

| | | | | |
|---|---|---|---|---|
| 6,057,518 | A * | 5/2000 | Bascom et al. | 200/43.17 |
| 6,058,815 | A | 5/2000 | Habermehl | |
| 6,070,292 | A * | 6/2000 | Langelaan | 15/401 |
| D434,620 | S * | 12/2000 | Martin | D8/8 |
| D439,417 | S * | 3/2001 | Woodnorth et al. | D4/138 |
| D481,601 | S * | 11/2003 | Ashfield | D8/65 |
| 6,742,215 | B2 * | 6/2004 | Panfili et al. | 15/236.01 |
| 6,871,623 | B2 * | 3/2005 | Ohsawa et al. | 123/179.18 |
| 2001/0010122 | A1 * | 8/2001 | Taomo et al. | 30/383 |
| 2002/0046468 | A1 * | 4/2002 | Kobayashi | 30/383 |
| 2003/0070308 | A1 * | 4/2003 | Ohsawa et al. | 30/381 |

FOREIGN PATENT DOCUMENTS

| | | |
|---|---|---|
| EP | 0811 315 | 12/1997 |
| SU | 954220 | 9/1982 |

* cited by examiner

PORTABLE HANDHELD WORK APPARATUS HAVING THUMB SUPPORTS

BACKGROUND OF THE INVENTION

Portable handheld work apparatus and especially chain saws, vacuum/blower apparatus or the like are carried and guided by the operator with a handle. The handle is configured as an upper handle of a so-called top-handle machine. Such a top handle lies approximately over the center of gravity of the work apparatus so that the work apparatus can be carried and guided with minimum exertion of effort in the rest position. Such a handle has an approximately circularly-shaped or oval cross section for ergonomic reasons. This cross section makes possible a comfortable grip for the guiding hand of the operator.

Specific operating procedures require a pivoting of the work apparatus about its longitudinal axis whereby a weight torque occurs because of the low-lying center of gravity of the apparatus relative to the handle. The rounded cross section of the handle makes it difficult for the operator to introduce an appropriate countermoment into the handle.

In known embodiments of the corresponding work apparatus, an additional handle is provided laterally of the housing of the apparatus for the second hand of the operator and this handle can be used in a supporting manner when there are pivot movements. In a manipulation of this kind, it is, however, necessary to provide guidance with both hands.

Portable handheld work apparatus are known wherein a thumb support is provided laterally on the handle whereat the thumb of the hand gripping the handle is supported. A pivot movement of the apparatus can be controlled in at least one direction via the thumb support. Nonetheless, it can be necessary to carry out pivot movements which can lead to an unwanted angling of the wrist which, for the operator, can limit the range of use.

SUMMARY OF THE INVENTION

It is an object of the invention to provide a portable handheld work apparatus which is so improved that it can be sensitively guided over a large area of use.

The portable handheld work apparatus of the invention includes a chain saw, vacuum/blower apparatus and the like. The work apparatus includes: a housing; a handle defining a longitudinal axis and being attached to the housing to permit an operator to carry and guide the work apparatus with the hand during an operational use thereof; and, the handle having first and second thumb supports formed thereon on both sides thereof relative to the longitudinal axis.

According to the invention, thumb supports are provided on respective sides of the handle with reference to the longitudinal axis of the handle. In this way, it is made possible to enable the operator to place the thumb of the hand, which surrounds the handle, on a suitable thumb support in dependence upon the pivot angle of the work apparatus whereby the work apparatus, supported by the thumb, can be aligned sensitively and guided over a wide pivot range. The arrangement of the thumb supports on both sides permits also an alternating grasping of the handle with the right and left hands which makes the work apparatus suitable especially for the use by left-handed operators without a constructive modification. The two thumb supports are therefore practically arranged symmetrically with respect to the longitudinal axis of the handle so that an excellent guiding quality is made possible independently of the selection of the guiding hand.

The thumb supports extend in a radial direction with respect to the longitudinal axis over a region which extends from the longitudinal axis of the handle by an amount up to approximately three times the handle radius. In this way, the thumb can find a support surface close to the handle in a relaxed position. For difficult work requiring a substantial effort, a corresponding large support radius can be selected for the thumb and a suitable supporting pivot movement can be applied to the handle.

In a practical further embodiment of the invention, the thumb support has a first component area having a portion lying approximately parallel to the longitudinal axis of the handle. With the horizontal component, a pivot movement can be developed about the longitudinal axis of the handle via a force acting perpendicularly on the surface. Here, only small tangential force components occur whereby a slippage, for example, because of sweat-coated fingers is avoided. The two first component surfaces of the two thumb supports are so arranged that they conjointly define a common plane whereby the thumb force can best develop its effect selectively on one of the sides of the handle independently of the selection of the component areas and the selection of the guiding hand.

In an advantageous embodiment of the invention, the thumb supports have a second component surface lying with a perpendicular component referred to the longitudinal axis of the handle. The last-mentioned component surfaces likewise conjointly define a common plane. With the perpendicular components of the two last-mentioned component surfaces, these surfaces can also function as support surfaces for the thumb against an axial slippage of the guiding hand on the handle. The respective first and second component areas extend one into the other with a rounded surface so that a suitable support surface can be felt for with the applied thumb with which a pressure can be applied approximately perpendicular to the surface without the thumb sliding off laterally.

In a practical further embodiment of the invention, an end of a second handle is fixed at at least one of the two thumb supports. With this direct proximity of the handle end to the thumb support, the thumb support can also be used for relaxing or for supporting the thumb of the hand closed about the handle. The handle itself makes possible the development of a greater hand force which can be sensitively supported via the thumb force. In difficult situations, wherein the operator inadvertently releases the handle, the absent hand force can be compensated by the thumb force. In a practical variation, a thumb support is configured as a grip knob which can be safely enclosed by a hand when guiding the work apparatus in difficult positions thereby making possible a reliable and safe holding of the apparatus.

An actuating element, for example, for a start automatic of the work apparatus, is provided between the two thumb supports and especially approximately centered therebetween on the side of the handle facing toward the above-described component areas of the thumb supports. This actuating element is easily reachable for the thumb in an ergonomic manner because of the centered arrangement between the two thumb supports. The excellent accessibility is ensured for right-handed operation as well as left-handed operation. Also, additional actuating elements for the work apparatus are provided on the handle approximately centered between the two thumb supports. The centered arrangement of the actuating elements makes possible an actuation in like manner with the right hand and the left hand.

The thumb supports advantageously include a slip-retarding surface so that the effect of the thumb supports is reliably ensured also in difficult ambient conditions such as with humidity.

The handle is advantageously in the form of two half shells and a thumb support is formed as one piece with each half shell. The two thumb supports are realizable in this way without additional manufacturing complexity. The thumb supports are especially produced in common with the two half shells from plastic in accordance with injection molding whereby, especially under series manufacturing conditions, even complex ergonomically adapted forms are possible.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
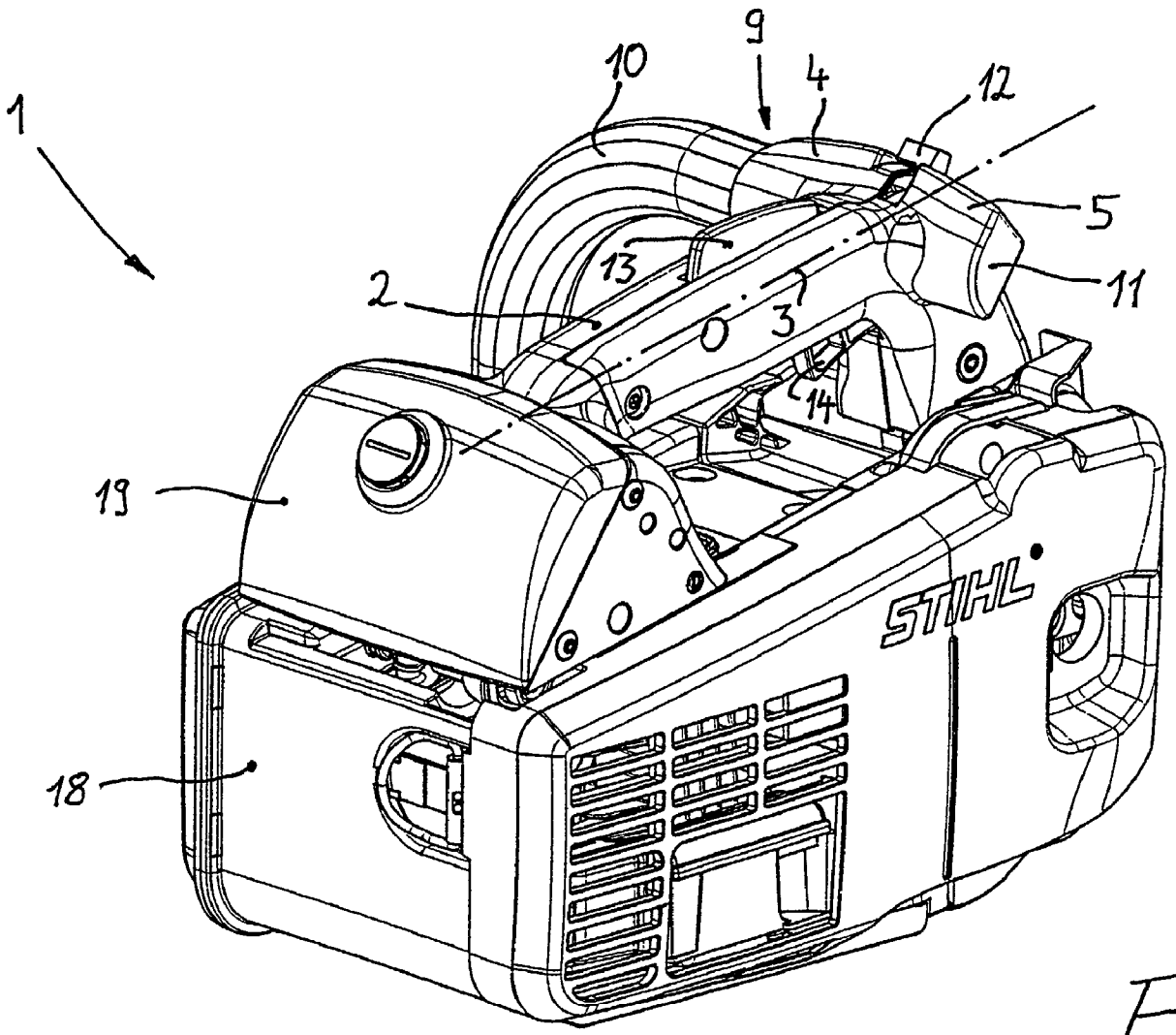
FIG. 1 is a perspective view of a portable handheld work apparatus and is shown here as a chain saw by way of example.

FIG. 1 shows a portable handheld work apparatus 1 in the form of a motor-driven chain saw. The chain saw is shown without a guide bar for the sake of clarity.

Figure 2:
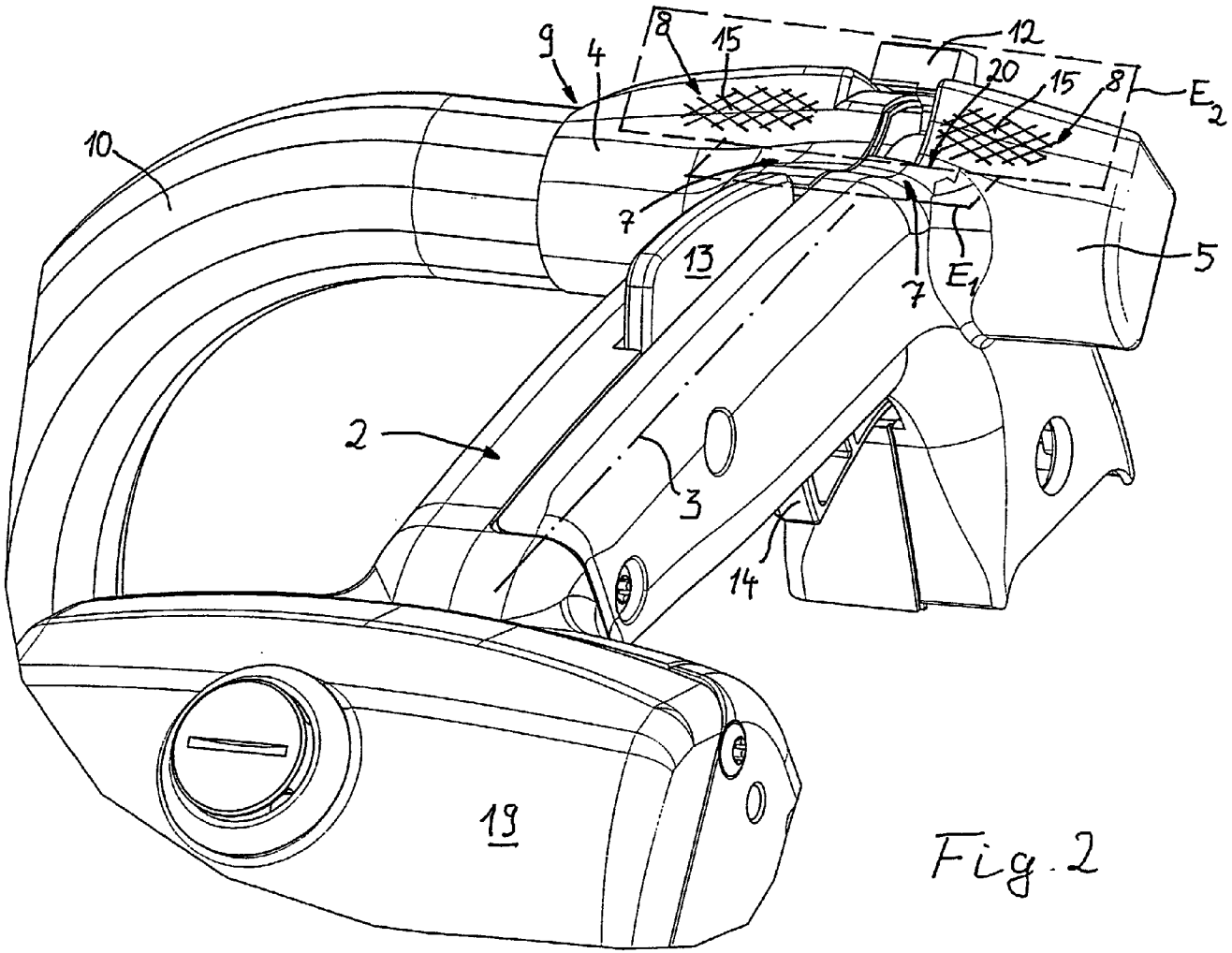
FIG. 2 is an enlarged detail view of the arrangement shown in FIG. 1 in the region of the handle; and, FIG. 3 is a plan view of the handle region of FIG. 2.

The work apparatus 1 includes a top handle 2 for carrying and guiding the work apparatus 1. A work apparatus of this kind is also known as a "top-handle machine". The upper handle 2 extends along a longitudinal axis 3 in the longitudinal direction of the work apparatus. The handle 2 is arranged above an apparatus housing 18 and extends rearwardly into an air filter case 19. At the end of the handle, which lies opposite the air filter case 19, thumb supports (4, 5) are provided on respective sides of the handle 2 with reference to its longitudinal axis 3. A holding handle 10 is arranged laterally thereof and has an end 9 fixed in the region of the thumb support 4. As shown in FIGS. 1 and 2, the end 9 of the handle 10 is connected to the thumb support 4. An actuating element 12 for the work apparatus is provided centrally between the two thumb supports (4, 5). In the embodiment shown, this actuating element is a switch for a start automatic which includes an emergency stop switch and a choke lever. Furthermore, an actuating element 13 in the form of a throttle lever latch is shown on the handle 2 approximately centrally between the two thumb supports (4, 5) on the side facing away from the apparatus housing 18 and a further actuating element 14 in the form of a throttle lever is arranged on the side facing toward the apparatus housing 18. The thumb support 5, which is arranged on the side opposite the end 9 of the handle 10, is configured as a grip knob 11 in the embodiment shown.

FIG. 2 shows an enlarged view of a detail of FIG. 1 in the region of the handle 2. Here, the two thumb supports (4, 5) each have two component areas (7, 8) arranged at an angle to each other. The two component areas 7 lie approximately parallel to the longitudinal axis 3 of the handle 2. The component areas 7 can be so arranged that one of their directional components (x-direction, y-direction) lies approximately parallel to the longitudinal axis 3. In the embodiment shown, the two first component areas 7 define a common plane $E_1$. It can, however, be practical that the two component areas 7 are arranged relative to each other so as to have, for example, a V-shape.

The two thumb supports (4, 5) have respective second component areas 8 which are so inclined with respect to the longitudinal axis 3 that they are provided with components perpendicular to this axis. Also, the two second component areas 8 form a common plane $E_2$ but can be so arranged that they are at an angle to each other. The two first component areas 7 extend into the adjoining two components areas 8 in the region of arrow 20 with a rounded surface. The two thumb supports (4, 5) are provided with a slip-retarding surface indicated by the cross hatching 15. The slip-retarding surface can comprise a structuring of the thumb support material or a suitable coating.

Figure 3:
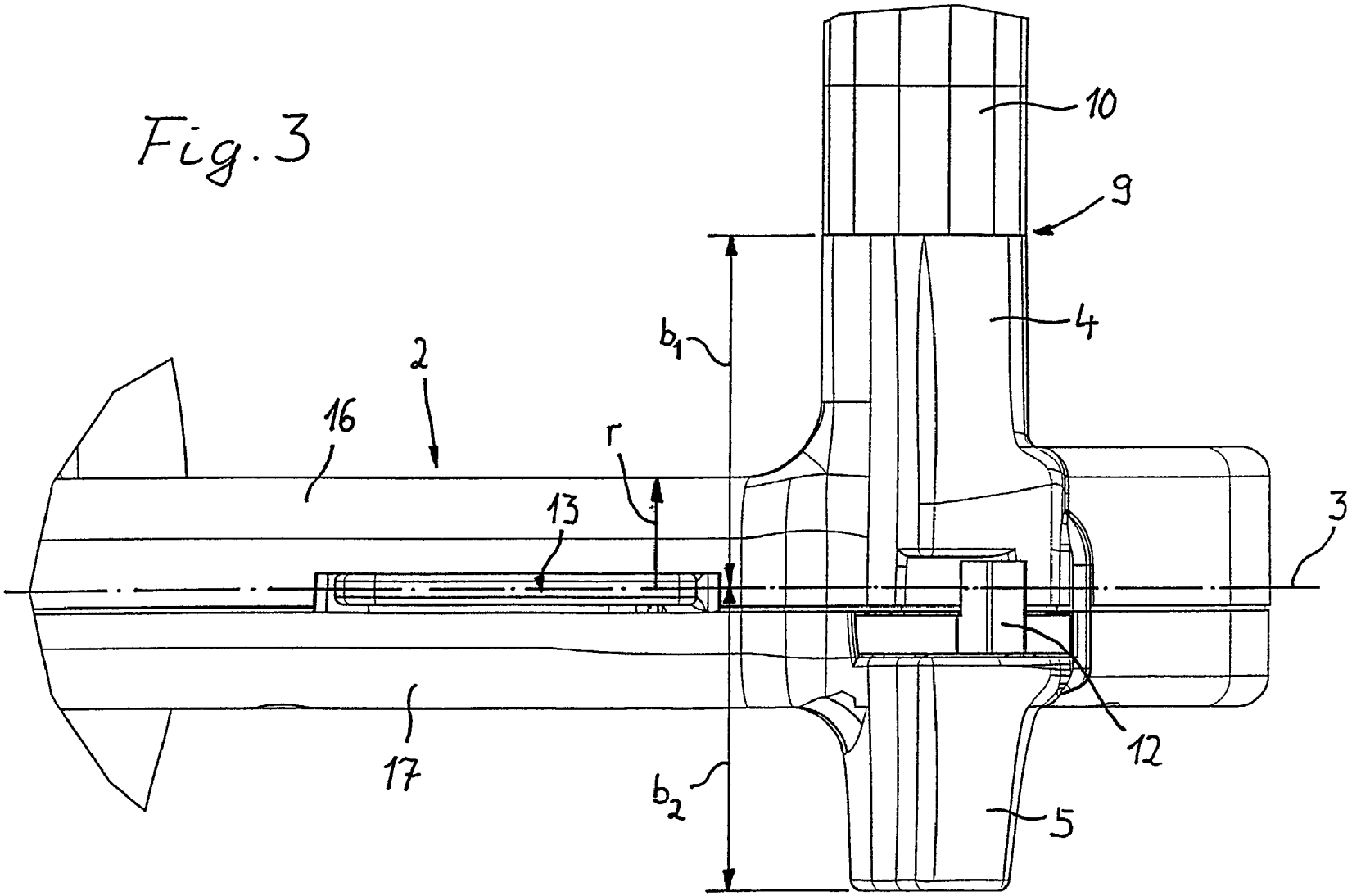

FIG. 3 shows, in a plan view, the handle arrangement of FIG. 2 wherein the actuating elements (12, 13) as well as the actuating element 14 (FIG. 1) are arranged approximately centrally in the region of the longitudinal axis 3 of the handle 2. The rounded handle 2 has a radius (r) traverse to its longitudinal axis 3. The two thumb supports (4, 5) extend in the radial direction outwardly from the longitudinal axis 3 each over a region ($b_1$, $b_2$) which corresponds approximately to three times the radius (r). The two thumb supports (4, 5) are arranged approximately symmetrically relative to the longitudinal axis 3.

The handle 2 is formed of two half shells (16, 17) on which the two thumb supports (4, 5) are formed as one piece. The two thumb supports (4, 5) are made of plastic by injection molding together with the respective half shells (16, 17).

It is understood that the foregoing description is that of the preferred embodiments of the invention and that various changes and modifications may be made thereto without departing from the spirit and scope of the invention as defined in the appended claims.

What is claimed is:

1. A portable handheld work apparatus comprising:

a housing;

a first handle;

said first handle being an upper handle and extending along a longitudinal axis in a longitudinal direction of the work apparatus and being attached to said housing to permit an operator to carry and guide the work apparatus with the hand during an operational use thereof;

said first handle having first and second thumb supports formed thereon on both sides thereof relative to said longitudinal axis;

said handle having a radius (r); said thumb supports extending over respective regions ($b_1$, $b_2$) in a radial direction with respect to said longitudinal axis; and, said regions ($b_1$, $b_2$) each extending radially up to approximately three times said radius (r);

said thumb supports including respective first component areas having respective portions lying approximately parallel to said longitudinal axis and which conjointly define a first common plane ($E_1$) and respective second component areas having respective portions lying perpendicular with respect to said longitudinal axis;

said first handle having a rounded transition surface region connecting said first component areas with corresponding ones of said second component areas;

said work apparatus further comprising a second handle for use by the operator, wherein said second handle is a side handle extending transversely to said first handle;

at least one of said thumb supports having an outer end facing toward said second handle; and, said second handle being arranged laterally of said thumb supports and having an end connected to said outer end of said at least one of said thumb supports.

2. The portable handheld work apparatus of claim 1, said second component areas conjointly defining a second common plane ($E_2$).

3. The portable handheld work apparatus of claim 1, further comprising an actuating element disposed between said first and second thumb supports; and, said actuating element being disposed so as to be centered between said thumb supports on the side of said component areas.

4. The portable handheld work apparatus of claim 1, wherein each of said first and second thumb supports has a slip-retarding surface.

5. The portable handheld work apparatus of claim 1, wherein said handle includes two half shells and said thumb supports are formed on corresponding ones of said half shells as a single piece therewith.

6. The portable handheld work apparatus of claim 5, wherein said half shells with said thumb supports are injection molded plastic parts.

7. The portable handheld work apparatus of claim 1, wherein said second component areas define a continuous surface uninterrupted by said handle.

8. A portable handheld work apparatus comprising:

a housing;

a first handle;

said first handle being an upper handle and extending along a longitudinal axis in a longitudinal direction of the work apparatus and being attached to said housing to permit an operator to carry and guide the work apparatus with the hand during an operational use thereof;

said first handle having first and second thumb supports formed thereon on both sides thereof relative to said longitudinal axis;

said handle having a radius (r); said thumb supports extending over respective regions ($b_1$, $b_2$) in a radial direction with respect to said longitudinal axis; and, said regions ($b_1$, $b_2$) each extending radially up to approximately three times said radius (r);

said thumb supports including respective first component areas having respective portions lying approximately parallel to said longitudinal axis and which conjointly define a first common plane ($E_1$) and respective second component areas having respective portions lying perpendicular with respect to said longitudinal axis;

said first handle having a rounded transition surface region connecting said first component areas with corresponding ones of said second component areas;

said work apparatus further comprising a second handle for use by the operator wherein said second handle is a side handle extending transversely to said first handle;

at least one of said thumb supports having an outer end facing toward said handle;

said second handle being arranged laterally of said thumb supports and having an end connected to said outer end of said at least one of said thumb supports; and, the other of said thumb supports being formed as a grip knob in a way to be enclosed by a hand.

9. A portable handheld work apparatus comprising:

a housing;

a first handle;

said first handle being an upper handle and extending along a longitudinal axis in a longitudinal direction of the work apparatus and being attached to said housing to permit an operator to carry and guide the work apparatus with the hand during an operational use thereof;

said first handle having first and second thumb supports formed thereon on both sides thereof relative to said longitudinal axis;

said handle having a radius (r); said thumb supports extending over respective regions ($b_1$, $b_2$) in a radial direction with respect to said longitudinal axis; and, said regions ($b_1$, $b_2$) each extending radially approximately three times said radius (r);

said thumb supports including respective first component areas having respective portions lying approximately parallel to said longitudinal axis and which conjointly define a first common plane ($E_1$) and respective second component areas having respective portions lying perpendicular with respect to said longitudinal axis;

said first handle having a rounded transition surface region connecting said first component areas with corresponding ones of said second component areas;

said work apparatus further comprising a second handle for use by the operator, wherein said second handle is a side handle extending transversely to said first handle;

at least one of said thumb supports having an outer end facing toward said second handle; and, said second handle being arranged laterally of said thumb supports and having an end connected to said outer end of said at least one of said thumb supports.

10. A portable handheld work apparatus comprising:

a housing;

a first handle;

said first handle being an upper handle and extending along a longitudinal axis in a longitudinal direction of the work apparatus and being attached to said housing to permit an operator to carry and guide the work apparatus with the hand during an operational use thereof;

said first handle having first and second thumb supports formed thereon on both sides thereof relative to said longitudinal axis;

said handle having a radius (r); said thumb supports extending over respective regions ($b_1$, $b_2$) in a radial direction with respect to said longitudinal axis; and, said regions ($b_1$, $b_2$) each extending radially approximately three times said radius (r);

said thumb supports including respective first component areas having respective portions lying approximately parallel to said longitudinal axis and which conjointly define a first common plane ($E_1$) and respective second component areas having respective portions lying perpendicular with respect to said longitudinal axis;

said first handle having a rounded transition surface region connecting said first component areas with corresponding ones of said second component areas;

said work apparatus further comprising a second handle for use by the operator wherein said second handle is a side handle extending transversely to said first handle;

at least one of said thumb supports having an outer end facing toward said second handle;

said second handle being arranged laterally of said thumb supports and having an end connected to an outer end of one of said thumb supports; and, the other of said thumb supports being formed as a grip knob in a way to be enclosed by a hand.

* * * * *